US006763533B2

(12) United States Patent
Mayer et al.

(10) Patent No.: US 6,763,533 B2
(45) Date of Patent: Jul. 20, 2004

(54) SINK DRAINAGE SYSTEM AND METHOD

(76) Inventors: Robert H. Mayer, 390 SE. Mizner Blvd. Apartment 1814, Boca Raton, FL (US) 33432; Nicole D. Mayer, 17026 Courtland La., Boca Raton, FL (US) 33496

( * ) Notice: Subject to any disclaimer, the term of this patent is extended or adjusted under 35 U.S.C. 154(b) by 0 days.

(21) Appl. No.: 10/460,918

(22) Filed: Jun. 13, 2003

(65) Prior Publication Data

US 2003/0213063 A1 Nov. 20, 2003

Related U.S. Application Data

(63) Continuation of application No. 10/085,936, filed on Feb. 28, 2002, now abandoned.

(51) Int. Cl.[7] ..... A47K 1/04

(52) U.S. Cl. ..... 4/650; 4/652; 4/643; 4/619; 4/286; 4/288

(58) Field of Search ..... 4/650, 652, 643, 4/619, 286, 288; 285/153

(56) References Cited

U.S. PATENT DOCUMENTS 928,032 A * 7/1909 Dawes ..... 4/288
3,914,807 A * 10/1975 Palmer ..... 4/287
4,146,939 A * 4/1979 Izzi ..... 4/286
4,694,513 A * 9/1987 Kiziah ..... 4/288
5,372,715 A * 12/1994 Maggard et al. ..... 210/165
5,560,052 A * 10/1996 Ferguson et al. ..... 4/650
5,940,898 A * 8/1999 Rowe ..... 4/286
6,066,119 A * 5/2000 Ball ..... 604/287

* cited by examiner

*Primary Examiner*—Henry Bennett
*Assistant Examiner*—Azy Kokabi
(74) *Attorney, Agent, or Firm*—Christopher & Weisberg, P.A.; Steven M. Greenberg

(57) ABSTRACT

A coupling system for securing a sink to a drain pipe. The coupling system of the present invention can include a support member and a flange connector. The flange connector can be coupled to the support member about opposite surfaces of a sink. The support member can include both a shoulder and a support surface opposite to the shoulder. The shoulder can be configured to support a sink and a gasket can be positioned thereon or within a recess therein to provide enhanced communication between a sink and the shoulder. The support surface, by comparison, can be configured to rest upon a support surface able to support the sink when coupled to the support surface.

5 Claims, 3 Drawing Sheets

SINK DRAINAGE SYSTEM AND METHOD

CROSS REFERENCE TO RELATED APPLICATIONS

This patent application is a continuation of presently U.S. patent application Ser. No. 10/085,936, entitled DRAINAGE SYSTEM, filed on Feb. 28, 2002 ABN, the contents of which are incorporated herein by reference.

BACKGROUND OF THE INVENTION

1. Statement of the Technical Field

The present invention relates generally to sink drainage systems, and more particularly to securing a sink to a drain pipe.

2. Description of the Related Art

Conventionally, plumbers secure sinks to drain pipes by way of a variety of coupling systems. A typical coupling system includes threaded fittings which are secured to the sink from a position below the sink. Given the placement of the threaded fittings and the ordinary weight of a sink, significant time and effort can be required to install or replace a sink. Recently, sinks having different ornamental designs which have been manufactured from different materials have become popular. In this regard, glass and ceramic sinks have become quite popular recently.

Yet, it is well know that glass and ceramic sinks are prone to chipping, scratching and breakage. When a sink has become chipped, scratched, or plain broken, the sink typically must be replaced. Even where a sink has not become damaged, many consumers often replace a sink merely for aesthetic purposes. Unfortunately, replacing a sink can be a difficult and error prone process. In particular, to support a sink while removing the drain coupling from below the sink often can invite disaster. Moreover, once the drain device of a sink has been removed, the drain pipe can fall away from the sink leaving the sink completely inoperable.

SUMMARY OF THE INVENTION

The present invention is a coupling system for securing a sink to a drain pipe. The present invention can overcome the limitations of conventional sink coupling systems by providing a novel and non-obvious system and method for securing a sink so that the sink can be removed without compromising the stability of the sink during the removal process. Moreover, through the use of the coupling system of the present invention, the sink can be removed without requiring the prerequisite decoupling of a drain pipe from the drain mechanism. Rather, a sink which has been configured with the coupling system of the present invention can be removed merely through the prerequisite removal of the drain mechanism from an intermediate sink support member which in turn can be coupled to the drain pipe.

In more particular illustration, a sink support member can be coupled to a drain pipe about opposite sides of a support surface such as a table or other surface able to support the sink and coupling system. The sink support member can include a drainage channel through which fluid can flow from the sink to the drain pipe. In this regard, the drainage channel within the sink support member can substantially align with a drainage channel within the drain pipe. An exterior surface of the sink can be positioned on a shoulder of the sink support member so that a drain opening within the sink substantially aligns with the drainage channel within the sink support member. In this configuration, the sink support member in conjunction with the support surface can support the sink in both an operable and stable manner even without securing the sink to the support member with a drain mechanism.

To secure the sink to the support member, a flange connector can be coupled to an interior surface of the sink and connected to the sink support member so that a drainage channel within the flange connector substantially aligns with the drainage channel of the sink support member through the drain opening. The flange connector further can include a flange for cleanly mating the flange connector to the interior of the sink without leaving gaps between the structure defining the drainage channel and the drain opening. Finally, a drain device, such as a drain hat can be attached to the top portion of the flange connector to complete the sink drainage system. Notably, gaskets can be applied at communicative joints between the sink and support member so as to provide an enhanced seal and to prevent leakage.

As it will be apparent from the foregoing, the coupling system of the present invention principally can include a support member and a flange connector. The flange connector can be coupled to the support member about opposite surfaces of a sink. The support member can include both a shoulder and a support surface opposite to the shoulder. The shoulder can be configured to support a sink and a gasket can be positioned thereon or within a recess therein to provide enhanced communication between a sink and the shoulder. The support surface, by comparison, can be configured to rest upon a support surface able to support the sink when coupled to the support surface. Notably, an engagement structure can be provided in which the flange connector can be firmly secured to the support surface. In a preferred aspect of the present invention, the engagement structure can be a mounting ring. In this regard, the mounting ring can be affixed to a threaded portion of the support member.

BRIEF DESCRIPTION OF THE DRAWINGS

There are shown in the drawing embodiments which are presently preferred, it being understood, however, that the invention is not limited to the precise arrangements and instrumentalities, wherein.

DETAILED DESCRIPTION OF THE PREFERRED EMBODIMENTS

Figure 1:
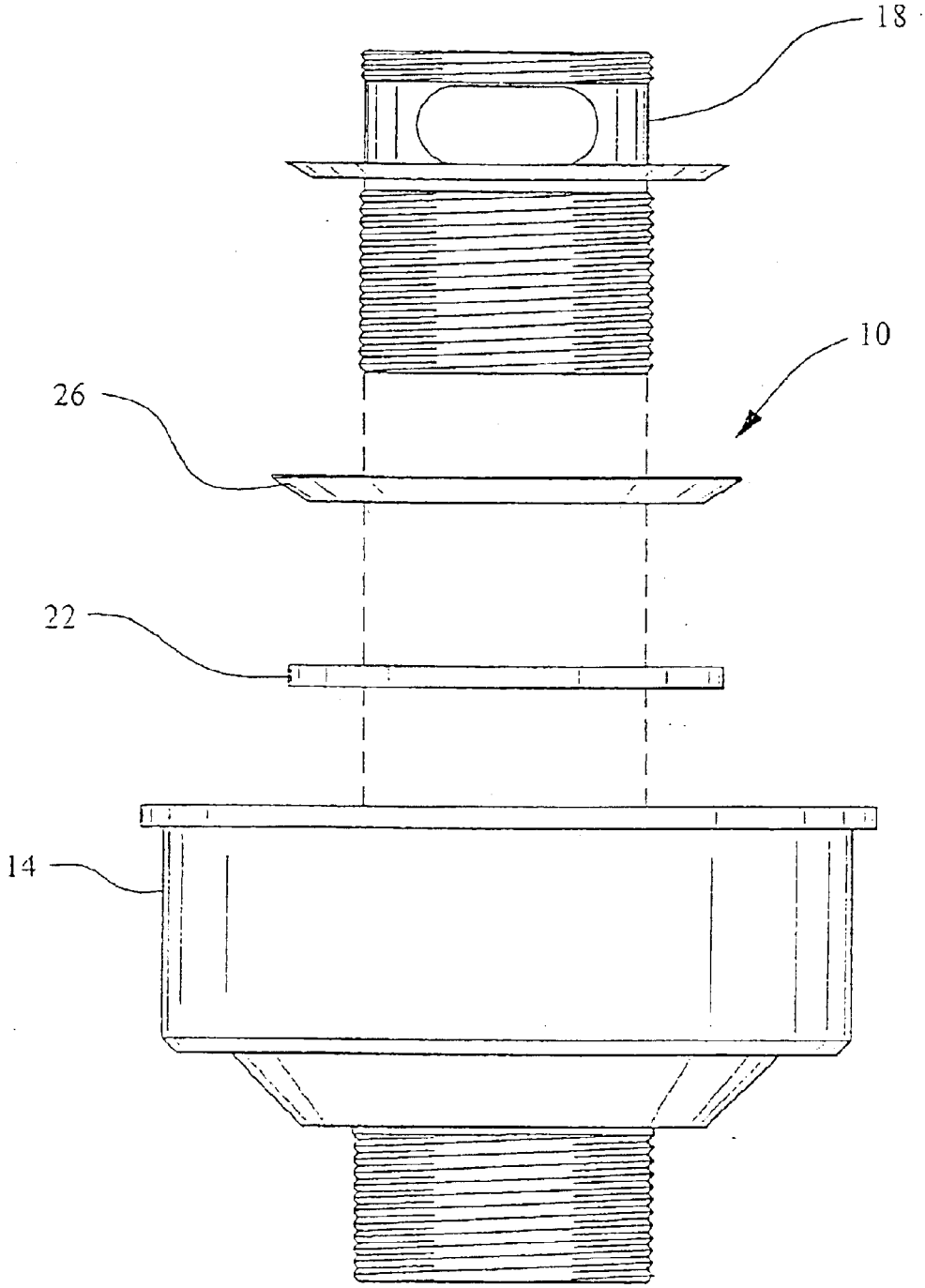
FIG. 1 is an exploded view of a coupling system for a sink.
Figure 2:
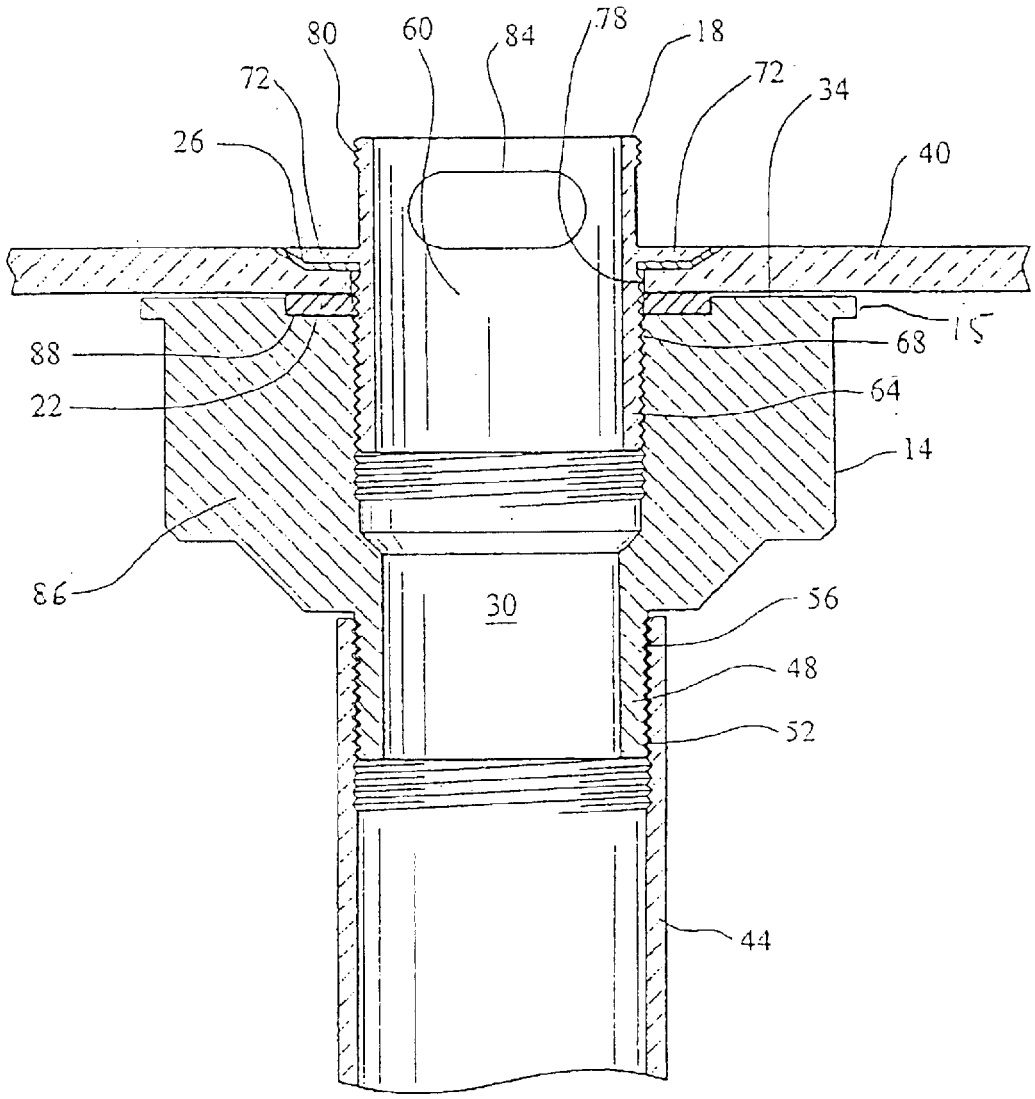
FIG. 2 is a cross-section of a sink system according to one aspect of the invention.

There is shown in FIG. 1 a coupling system 10 which has been configured in accordance with the present invention. The coupling system can include a support member 14 and a flange connector 18. A first gasket 22 and second gasket 26 can also be provided. As shown in FIG. 2, the support member 14 can include a drainage channel 30 and the support member 14 further can include a shoulder 34 for supporting a sink 40. For purposes of the invention, a sink can be any type of suitable structure for receiving and draining any suitable type of fluid such as water.

Importantly, the support member 14 can have structure for engaging drain pipe 44. Morever, an extension 48 can be provided with threads to engage cooperating threads on the drain pipe 44. In the embodiment shown, the extension 48 has male threads 52 which can be adapted to engage cooperating female threads 56 on an interior surface of the drain pipe 44. It is possible, however, to dimension the extension 48 such that the drain pipe 44 fits within the extension 48, and in this embodiment the drain pipe 44 would be provided with male threads and the extension 48 would be provided with female threads. Other structure for engaging the support member 14 to the drain pipe 44 is also possible, including various fittings adapted for that purpose.

The flange connector 18 can have a drainage channel 60. The flange connector 18 has structure for engaging the support member 14. The flange connector 18 can be tubular and have male threads 64 which engage cooperating female threads 68 on the support member 14, although other engagement structure is possible. The drainage channel 30 of the support member 14 can communicate with the drainage channel 60 of the flange connector 18 when the flange connector 18 is engaged to the support member 14 to permit water or other suitable fluids to flow from the sink, through the flange connector 18, the support member 14, and into the drain pipe 44.

The flange connector 18 can also have a flange 72. The flange 72 can extend about the periphery of the flange connector 18 and can be dimensioned such that it will not pass through the drain opening 78 of the sink 40. The flange 72 can press firmly against the sink 40 when the flange connector 18 is engaged and tightened to the support member 14. As such, the flange 72 can add to the watertight integrity of the engagement between the flange connector 18 and the support member 14. In addition, the flange can also increase the stability of the system 10 once a sink 40 has been installed.

The flange connector 18 can also have structure for engaging drain devices such as a drain hat (not shown). Alternatively, the flange connector 18 can support a pop-up drain plug (not shown). Male threads 80 can be provided to engage female threads of the drain hat or drain plug to be coupled to the flange connector 18. An opening 84 in the flange connector 18 can be provided to permit water or any other suitable fluid to flow from the sink 40 to the drainage channel 60.

It is preferable to seal the sink 40 against the support member 14 to prevent leaks. The gasket 22 can be provided for this purpose. The gasket 22 can be annular to allow the flange connector 18 to extend through the gasket 22 into the drainage channel 30 of the support member 14. The gasket 22 can be made out of any suitable material such as rubber or silicone. In one embodiment, the support member 14 has a main body portion 86. A recess 88 can be provided in the main body portion 86. The gasket 22 can be received by the recess 88 to secure the gasket 22 in position. The gasket 22 should be dimensioned such that, when it is positioned in the recess 88, it can extend above the shoulder 34 so that it will be partially compressed by the sink 40 when the flange connector 18 is tightened against the support member 14. The flange 72 can be sealed against the sink 40 to prevent leaks. A gasket 26 can be provided and can be compressed between the flange 72 and sink 40 when the flange connector 18 is tightened against the support member 14. Other sealing methods, such as the application of caulks and other sealants, are possible.

In operation, the support member 14 can be connected to the drain pipe 44. The gasket 22 can be positioned on the support member 14, such as in the recess 88. The sink 40 can then be placed onto the shoulder 34 of the support member 14, with the drain opening 78 substantially aligned with the drainage channel 30. The flange connector 18 can then be positioned through the opening 78 and into the drainage channel 30 of the support member 14. The flange connector 18 is then tightened to the support member 14, whereupon the flange 72 presses against the sink 40 to secure the sink 40 in position against the support member 14. The drain device, such as a drain hat or pop-up drain plug, can then be connected to the flange connector 18, as by threads 80.

Replacement of the sink is accomplished by removing the drain device and disconnecting the flange connector 18 from the support member 14. Alternatively, the flange connector 18 can be disconnected from the support member 14 without removing the drain device. The sink 40 can then be lifted from the shoulder 34 of support member 14, and replaced with another sink. The flange connector 18 is then reconnected as previously described. As such, the inventive arrangements permit the installation and removal of a sink 40 merely by coupling or decoupling a single component (the flange connector 18) to or from a drain pipe.

Figure 3:
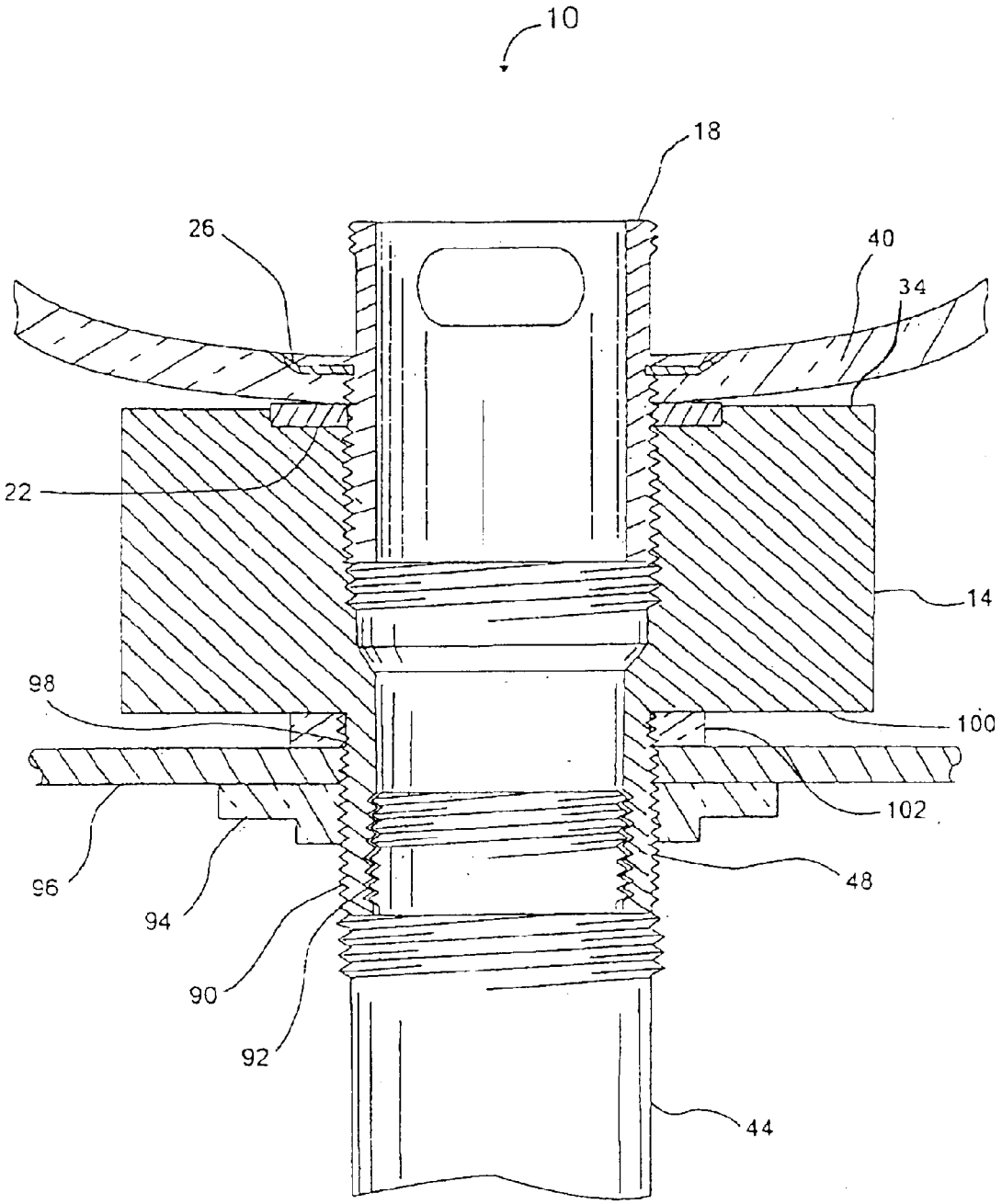
FIG. 3 is a cross-section of a sink system according to another aspect of the invention.

FIG. 3 shows a preferred coupling system 10 within contemplation of the inventive arrangements. Similar to the coupling system 10 described in connection with FIGS. 1 and 2, the coupling system 10 shown in FIG. 3 can have a flange connector 18, a support member 14, a first gasket 22, a second gasket 26 and a drain hat (not shown) or a pop-up drain plug (not shown). In addition, the support member 14 of this particular arrangement can include a drain extension 48. Significantly, the support member 14 can include both a shoulder 34 for supporting a sink, and a support surface 100 which is opposite to the shoulder 34. The support surface 100 can be substantially flat so as to permit the communication of the support member 14 with a support structure 96, for instance a support table.

Although FIG. 3 illustrates the drain extension 48 and the support member 14 as a unitary piece, it must be noted that the invention is not limited in this regard; the drain extension 48 and the support member 14 can be separate components, and the drain extension 48 can be detachably coupled to the support member 14. In one arrangement, the drain extension 48 can include male threads 90 and can also include female threads 92. As shown in FIG. 3, the female threads 92 can be used to engage a drain pipe 44 having cooperating male threads. Alternatively, the male threads 90 can be used to engage a drain pipe 44 having cooperating female threads. Moreover, other structure for engaging the support member 14 to the drain pipe 44 is also possible, including various fittings adapted for that purpose.

The coupling system 10 of FIG. 3 can also include a mounting ring 94. The mounting ring 94 can include cooperating threads for engaging the male threads 90 of the supporting member 14 or the drain extension 48. In one arrangement, the supporting member 14 can be placed on the support structure 96, which can include an aperture 98 for receiving the drain extension 48. A third gasket 102 can be positioned between the support surface 100 and the countertop 96 to ensure a proper fit. The third gasket 102 can be silicone, rubber or any other suitable material. If desired, another gasket (not shown) can be positioned between the mounting ring 94 and the support structure 96.

To install a sink 40, the drain extension 48 of the support member 14 can be inserted through the aperture 98 of the support structure 96. The support member 14 can rest against the third gasket 102. The drain extension 48 can then be secured to the drain pipe 44, and the mounting ring 94 can be used to secure the support member 14 to the support structure 96. Similar to the operation described in relation to FIG. 2, the gasket 22 can be positioned on the support member 14, and the sink 40 can then be placed onto the shoulder 34 of the support member 14. The flange connector 18 can then be coupled to the support member 14, and the drain device (not shown) can then be connected to the flange connector 18. Replacement of a sink can be in accordance with the procedure described above in relation to FIG. 2.

The components of the coupling system of the present invention can be manufactured from standard plumbing materials, including metals and plastics. Additionally, the coupling system of the present invention can be made in a variety of different styles and sizes without departing from the principals of the invention. Finally, the coupling system of the present invention can be embodied in other forms without departing from the spirit or essential attributes thereof, and accordingly, reference should be had to the following claims, rather than to the foregoing specification, as indicating the scope of the invention.

What is claimed is:

1. A coupling system, for securing a sink to a drain pipe, comprising:

a flange connector having a drainage channel and a peripheral flange; and, a sink support member configured for coupling to said flange connector comprising a shoulder, a support surface opposite said shoulder, and a drainage channel, said shoulder having a configuration for supporting the sink with said drainage channel of said flange connector in substantial alignment with said drainage channel of said sink support member, said support surface having a configuration for communicating with support structure to support both said flange connector and said sink support member when coupled to one another over said support structure, wherein said support member further comprises engagement structure for securing said sink support member to said support structure, wherein said engagement structure comprises cooperating threads and a mounting ring.

2. A coupling system for securing a sink to a drain pipe, comprising:

a flange connector having a drainage channel and a peripheral flange; and, a sink support member configured for coupling to said flange connector comprising a shoulder, a support surface opposite said shoulder, and a drainage channel, said shoulder having a configuration for supporting the sink with said drainage channel of said flange connector in substantial alignment with said drainage channel of said sink support member, said support surface having a configuration for communicating with support structure to support both said flange connector and said sink support member when coupled to one another over said support structure, wherein said sink support member further comprises an extension disposed at an end of said sink support member opposite said shoulder for engaging a drain pipe.

3. A coupling system for securing a sink to a drain pine, comprising:

a flange connector having a drainage channel and a peripheral flange; and, a sink support member configured for coupling to said flange connector comprising a shoulder, a support surface opposite said shoulder, and a drainage channel, said shoulder having a configuration for supporting the sink with said drainage channel of said flange connector in substantial alignment with said drainage channel of said sink support member, said support surface having a configuration for communicating with support structure to support both said flange connector and said sink support member when coupled to one another over said support structure, wherein said sink support member further comprises an extension disposed at an end of said sink support member opposite said shoulder for engaging a drain pine, wherein said system further comprises a gasket for sealing said sink support member to a sink, wherein said sink support member comprises a seat for said gasket, wherein said gasket is an annular gasket, wherein said seat comprises a recess disposed in a main body portion of said sink support member, said gasket being dimensioned to fit within said recess.

4. A sink system comprising:

a sink having a drain opening;

a sink support member having each of a shoulder to support said sink, a support surface opposite said shoulder, and a drainage channel;

a flange connector having a drainage channel and a peripheral flange; and, engagement structure configured to secure said sink support member to a support structure for supporting a coupling of said sink, sink support member and flange connector when said drain opening and drainage channels substantially communicate in said coupling, wherein said engagement structure is a mounting ring attached to a threaded portion of said sink support member.

5. A system comprising:

a sink having a drain opening;

a sink support member having each of a shoulder to support said sink, a support surface opposite said shoulder, and a drainage channel;

a flange connector having a drainage channel and a peripheral flange; and, engagement structure configured to secure said sink support member to a support structure for supporting a coupling of said sink, sink Support member and flange connector when said drain opening and drainage channels substantially communicate in said coupling, wherein said engagement structure is a mounting ring attached to a threaded portion of said flange connector.

* * * * *